US008273239B2

(12) United States Patent
Glass et al.

(10) Patent No.: US 8,273,239 B2
(45) Date of Patent: Sep. 25, 2012

(54) CORROSION PROTECTION OF STEEL IN CONCRETE

(76) Inventors: Gareth Kevin Glass, Lichfield (GB); Adrian Charles Roberts, Chilwell (GB); Nigel Davison, Coton-in-the-elms Swadlincote (GB)

( * ) Notice: Subject to any disclaimer, the term of this patent is extended or adjusted under 35 U.S.C. 154(b) by 158 days.

(21) Appl. No.: 12/814,120

(22) Filed: Jun. 11, 2010

(65) Prior Publication Data

US 2010/0314262 A1 Dec. 16, 2010

(30) Foreign Application Priority Data

Jun. 15, 2009 (GB) ..... 0910167.6

(51) Int. Cl.

| | |
|---|---|
| ***C23F 13/14*** | (2006.01) |
| ***C23F 13/08*** | (2006.01) |
| ***C23F 13/10*** | (2006.01) |
| ***C23F 13/12*** | (2006.01) |
| ***C23F 13/16*** | (2006.01) |

(52) U.S. Cl. ..... 205/734; 205/730; 205/731; 205/733; 204/196.37; 204/196.1; 204/196.23; 204/196.24; 204/196.25; 204/196.17; 204/196.3

(58) Field of Classification Search ..... 204/196.1, 204/196.23–196.25, 196.17, 196.3, 196.37; 205/730, 731, 733, 734

See application file for complete search history.

(56) References Cited

U.S. PATENT DOCUMENTS

| | | | | |
|---|---|---|---|---|
| 4,861,449 | A | 8/1989 | St. Onge | |
| 5,292,411 | A | 3/1994 | Bartholomew et al. | |
| 6,022,469 | A | 2/2000 | Page | |
| 6,258,236 | B1 | 7/2001 | Hird | |
| 6,322,691 | B1 | 11/2001 | Miller | |
| 6,419,816 | B1 * | 7/2002 | Lyublinski | 205/734 |

(Continued)

FOREIGN PATENT DOCUMENTS

| | | | |
|---|---|---|---|
| GB | 2 426 008 | A | 11/2006 |

(Continued)

OTHER PUBLICATIONS

ACI RAP Bulletin 8, Field Guide to Concrete Repair Application Procedures, Installation of Embedded Galvanic Anodes.

*Primary Examiner* — Bruce Bell
(74) *Attorney, Agent, or Firm* — Davis & Bujold, PLLC

(57) ABSTRACT

An electric field modifier for boosting a current output of a sacrificial anode to enhance its protective effect and direct the current output to improve current distribution in galvanic protection of steel in a concrete element exposed to air is disclosed. A cavity is formed in a concrete element and a combination comprising a sacrificial anode, an electric field modifier and an ionically conductive filler are embedded therein. The sacrificial anode is connected to the steel. The modifier comprises an element with an anode side, supporting an oxidation reaction, in electrical contact with a cathode side, supporting a reduction reaction. The cathode of the modifier faces the sacrificial anode and is separated therefrom by a filler which contains an electrolyte that connects the sacrificial anode to the cathode of the modifier. The anode of the modifier faces away from the sacrificial anode. Preferably, the reduction reaction, on the cathode of the modifier, comprises reduction of oxygen from the air.

22 Claims, 6 Drawing Sheets

U.S. PATENT DOCUMENTS

| | | | | |
|---|---|---|---|---|
| 6,685,822 | B2 | 2/2004 | Buenfeld et al. | |
| 6,793,800 | B2 | 9/2004 | Whitmore | |
| 7,097,746 | B1 * | 8/2006 | Tziviskos et al. | 204/196.23 |
| 7,264,708 | B2 | 9/2007 | Whitmore et al. | |
| 7,648,623 | B2 | 1/2010 | Glass | |
| 7,704,372 | B2 | 4/2010 | Glass et al. | |
| 2007/0109949 | A1 | 5/2007 | Efimov | |
| 2008/0073223 | A1 * | 3/2008 | Glass | 205/734 |
| 2008/0105564 | A1 * | 5/2008 | Glass et al. | 205/734 |
| 2009/0229993 | A1 | 9/2009 | Glass et al. | |

FOREIGN PATENT DOCUMENTS

| | | | |
|---|---|---|---|
| GB | 2 431 167 | A | 4/2007 |
| GB | 2 451 725 | A | 2/2009 |
| WO | 94/29496 | A1 | 12/1994 |
| WO | 2004/057056 | A2 | 7/2004 |
| WO | 2005/106076 | A2 | 11/2005 |
| WO | 2005/121760 | A1 | 12/2005 |

* cited by examiner

CORROSION PROTECTION OF STEEL IN CONCRETE

FIELD OF THE INVENTION

The present invention relates to electrochemical protection of steel in reinforced concrete construction using sacrificial anodes and, in particular, to the use of distributed discrete sacrificial anode assemblies in arresting steel corrosion in corrosion damaged concrete elements which are exposed to the air.

BACKGROUND OF THE INVENTION

As is well known in the art, above ground steel reinforced concrete structures suffer from corrosion induced damage mainly as the result of carbonation or chloride contamination of the concrete. As the steel reinforcement corrodes, it produces byproducts that occupy a larger volume than the steel from which the byproducts are derived. As a result, expansion occurs in the concrete around reinforcing steel bars. This causes cracking and delamination of the concrete cover over the steel. Typical repairs involve removing this patch of corrosion damaged concrete from the reinforced concrete structures. It is good practice to expose corroding steel, at the area of damage, and to remove the concrete (e.g., break it up an remove) behind the corroding steel. The concrete profile is then restored with a compatible cementitious repair concrete or mortar, for example. The concrete then consists of the "parent" concrete (i.e., the remaining original concrete) and the new "patch" repair material.

The parent concrete, adjacent the repair area, is typically likely to suffer from some of the same chloride contamination or carbonation that caused the original corrosion damage. It is to be appreciated that steel corrosion still remains a risk in the parent concrete. Corrosion in concrete is an electrochemical process and electrochemical treatments have been used to treat this corrosion risk. Examples are described in WO 94029496, U.S. Pat. No. 6,322,691, U.S. Pat. No. 6,258,236 and U.S. Pat. No. 6,685,822.

Established electrochemical treatments generally include cathodic protection, chloride extraction and re-alkalisation. These have been classed as either permanent or temporary treatments. Permanent treatments are based on a protective effect that is only expected to last while the treatment is applied. An example of a permanent treatment is cathodic protection. The accepted performance criterion can only be achieved while the treatment is applied (BS EN 12696:2000). Chloride extraction and re-alkalisation are examples of temporary treatments (CEN/TS 14038-1:2004). Temporary treatments rely on a protective effect that persists after the treatment has ended. In practice, this means that an applicator treats the structure and thereafter hands a treated structure back to a client or customer at the end of a treatment contract.

Electrochemical treatments may also be classed as either impressed current or galvanic (sacrificial) treatments. In impressed current electrochemical treatments, the anode is connected to the positive terminal and the steel is connected to the negative terminal of a source of DC power. In galvanic electrochemical treatments, the protective current is provided by one or more sacrificial anodes that are directly connected to the steel. Sacrificial anodes are electrodes comprising metals which are less noble than steel with the main anodic reaction being the dissolution of a sacrificial metal element.

In the galvanic protection of steel in concrete, when the sacrificial anode is connected to the steel, the natural potential difference between the sacrificial anode and the steel drives a protective current. The protective current flows, as ions, from the sacrificial anode into the parent concrete and to the steel, and then returns as electrons through the steel and a conductor to the sacrificial anode. The convention of expressing the direction of current flow, as the direction of movement of the positive charge, is used in this description.

Sacrificial anodes for concrete structures may be divided into discrete or continuous anodes (U.S. Pat. No. 5,292,411). Discrete anodes are individually distinct elements that contact a concrete surface area that is substantially smaller than the surface area of the concrete covering the protected steel. The anode elements are normally connected to each other through a conductor that is not intended to be a sacrificial anode and are normally embedded within cavities in the concrete (ACI Repair Application Procedure 8—Installation of Embedded Galvanic Anodes (www.concrete.org/general/RAP-8.pdf)). Discrete sacrificial anode systems generally include an anode, a supporting electrolyte and a backfill. An activating agent, to maintain the activity of the sacrificial anode, may be included. The backfill provides space to accommodate the products of anodic dissolution and prevent disruption of the surrounding hardened concrete. Discrete sacrificial anodes have the advantage that it is relatively easy to achieve a durable attachment between the anode and the concrete structure. This is typically achieved by embedding the anode within a cavity formed within the concrete.

Galvanic protection of steel in concrete, using embedded discrete anodes, differs from sacrificial cathodic protection of steel in soil and water (BS EN 12954:2001). Anode assemblies that are embedded within concrete must be dimensionally stable as concrete is a rigid material that does not tolerate expansion of any embedded assembly. Anode activating agents are specific to concrete or need to be arranged in a way that would present no corrosion risk to the neighbouring steel (WO 94029496 or GB 2431167). Anodes are located in the concrete relatively close to the steel and embedded anodes are generally small (e.g., a discrete anode assembly diameter is typically less than 50 mm), when compared to anodes in other environments. Galvanic protection criteria, for atmospherically exposed concrete, differ from those for the cathodic protection of steel in soil or water.

One problem with the use of sacrificial anodes, in galvanic treatments, is that the power to arrest an active corrosion process on steel in concrete is limited by the voltage difference between the sacrificial anode and the steel. This problem is greatest for discrete sacrificial anode systems where, in order to protect relatively large surfaces of steel, large currents are required from relatively small anodes. A compact discrete anode will typically deliver current into an area of parent concrete, adjacent to the anode, that is one tenth to one fiftieth of the area of the steel it is expected to protect.

A number of methods have been recently proposed to increase the power of sacrificial anodes in concrete using a form of impressed current (see for example WO 05106076, U.S. Pat. No. 7,264,708 and GB 2426008). Some early teaching also exists on increasing the power of a sacrificial anode in sacrificial cathodic protection applications applied to steel in soil and saline water where different protection criteria apply (U.S. Pat. No. 4,861,449).

In WO 05106076, a sacrificial anode assembly is formed by connecting the cathode of a cell or a battery to a sacrificial anode. In one arrangement, the sacrificial anode forms the casing of a cell where the cathode of the cell is adjacent to the cell casing. An alkaline cell commonly has this property. The anode of the cell is then connected to the steel. The problem with this arrangement is that the sacrificial anode is not connected to the steel and the charge capacity of a cell is substantially smaller than the charge capacity of a similarly sized sacrificial anode. Because the anode is not connected directly to the steel, the anode cannot continue to deliver a protective current once the charge capacity of the cell has expired.

In U.S. Pat. No. 7,264,708, an automated means is provided to connect a sacrificial anode to the steel after a power supply or battery driving current from the sacrificial anode to the steel has expired. In the example in this disclosure, diodes are used to provide the sacrificial anode to steel connection. The problem with this arrangement is that power is required to achieve such a connection and this reduces the power of the protective effect. A typical diode (e.g., a silicon based diode) will use a voltage of 0.6 V to become a conductor and there is not sufficient voltage within a typical sacrificial anode system to drive a substantial current through such diodes. Another problem with this arrangement is that the power supply is located away from the anodes and is connected to the anodes with electrical cables that have to be maintained and protected from the environment and also from vandalism.

GB 2426008 (U.S. patent application Ser. No. 11/908,858) discloses a new basis for corrosion initiation and arrest in concrete that relies on an acidification-pit re-alkalisation mechanism. A temporary electrochemical treatment is used to deliver a pit re-alkalisation process from sacrificial anodes before the anodes are manually connected to the steel. The pit re-alkalisation process arrests active corrosion by restoring a high pH at the corroding sites. The pit re-alkalisation process (e.g., temporary impressed current treatment) typically lasts less than 3 weeks. The corrosion free condition is then maintained with the low level galvanic generation of hydroxide at the steel. The switch between the impressed current and galvanic treatments is achieved manually and this is facilitated by the limited duration of the temporary impressed current treatments. The power supply and the electric cables used for the temporary impressed current treatment are removed from the site. The problem with this disclosure is that the temporary impressed current treatment generally requires a skilled operator.

Another problem with discrete sacrificial anode systems is current distribution. This problem is greatest for anodes that are tied to exposed steel in cavities formed within the concrete at areas of the concrete repair. A number of solutions have been proposed to improve the current distribution from an anode tied to the steel (GB 2451725, WO 05121760 and WO 04057056, for example). However these solutions are all based on restricting the current flow to the nearest steel by increasing the resistance for current to flow to the nearest steel.

The problem to be solved by this invention is to increase the initial power, available from a sacrificial anode assembly, in order to arrest an active corrosion process while the sacrificial anode is connected to the steel in the concrete, and to improve current distribution from a sacrificial anode, connected to the steel, by directing an increased current away from the nearest steel.

SUMMARY OF THE INVENTION

This invention relates to a method of controlling the current output from discrete sacrificial anodes, that are less noble than steel, using additional anode-cathode assemblies to modify the electric field in the environment next to the anode while the sacrificial anode is connected to the steel in the concrete. In one arrangement, an electric field modifier with an air cathode is used to sustain a high current output from a sacrificial anode embedded in concrete. The use of an air cathode in the modifier needs to be combined with an environment like concrete exposed to the air because in this environment, cathodic protection is achieved by changing the environment at the steel to induce steel passivity or anodic polarization. In an environment, like soil and water, where cathodic protection is achieved by cathodically polarizing the steel, an air cathode will not work because the steel to be protected represents an air cathode with a very large surface area relative to the air cathode that might be assembled within an anode assembly and, therefore, the air cathode in the anode assembly will not have the capacity to deliver the necessary protective current.

In an alternative arrangement, an electric field modifier is placed in the environment adjacent to the sacrificial anode to provide an initial boost to the sacrificial anode current output in order to arrest the corrosion process, and the sacrificial anode continues to function, even after the charge in the modifier has been consumed, because it is connected to the steel through an electron conducting conductor and a path for ionic current is formed through an electrolyte to the protected steel. The path for ionic current is formed at least after the modifier has stopped functioning. In this case, the life of the sacrificial anode, determined in part by its charge capacity, is substantially greater than the life of the modifier in the anode assembly.

In another alternative arrangement, an electric field modifier is arranged to boost the current from the sacrificial anode that flows to steel further away from the anode relative to the current that flows to the steel closer to the anode. In this case the sacrificial anode preferably has a face that is tied to a steel bar and the modifier is arranged to boost the current flowing away from this face.

The electric field modifier contains at least one anode electrode, electronically connected by an electron conducting conductor, to at least one cathode electrode and the anode and the cathode face away from each other. The oxidation reaction on the anode (anode reaction) and the reduction reaction on the cathode (cathode reaction) can occur without any external driving potential. One type of electric field modifier is an element comprising a first side or face that is an anode supporting an oxidation reaction that is in electrical contact with a second side or face that is a cathode supporting a reduction reaction so that the anode and the cathode face away from each other (i.e., the anode and the cathode both face in substantially different directions). A natural potential difference is generated by the oxidation and the reduction reactions on the anode and the cathode, respectively, that tries to drive a current through the modifier. If an electrolyte connects the anode of the modifier to its cathode, the circuit will be complete and a current will flow from the anode to the cathode. Electrochemical reactions consume the reducing and the oxidizing agents at the anode and cathode, respectively (i.e., the reductants are oxidized and oxidants are consumed at the anode and cathode, respectively). It is preferable that these reactions should be restricted prior to use to enhance the shelf life of the modifier. This may be achieved by keeping the modifier in a dry environment in order to limit the quantity of electrolyte at the anode and the cathode, and/or by preventing the electrolyte at the anode from making contact with the electrolyte at the cathode. The modifier is located in the electric field between the sacrificial anode and the steel. The modifier increases the current flowing through a path that intersects the modifier when the cathode of the modifier faces the sacrificial anode and the anode of the modifier faces away from the sacrificial anode. In this arrangement, the modifier may also be used to increase the total current delivered by the sacrificial anode. The modifier effectively behaves as a current pump that pumps electric current through the modifier.

BRIEF DESCRIPTION OF THE DRAWINGS

This invention will now be described further with reference, by way of example, to the accompanying drawings in which.

DETAILED DESCRIPTION OF THE INVENTION

Figure 1:
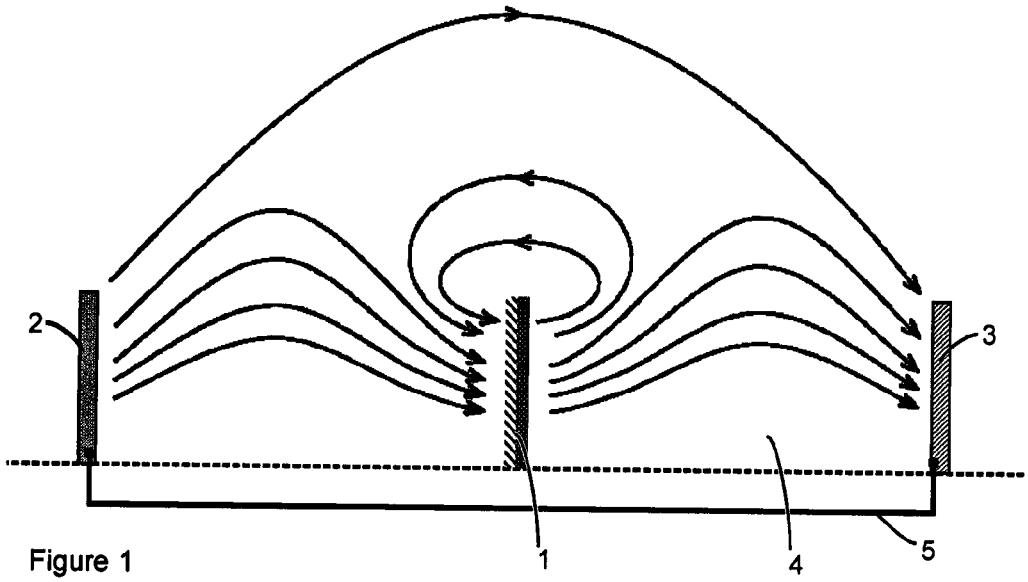
FIG. 1 diagrammatically illustrates the effect of an electric field modifier on the current flow between a sacrificial anode and the steel.

The effect of an electric field modifier, on current flow, is illustrated in FIG. 1. In this example, a modifier 1 is placed in an electrolyte 4 between a sacrificial anode 2 and a protected steel 3. The sacrificial anode 2 is connected to the steel 3 via a connection 5. A galvanic protective current flows from the sacrificial anode 2 through the electrolyte 4 to the steel 3 and returns to the sacrificial anode 2 via the connection 5. The modifier 1 has a surface facing the anode 2 that acts as a cathode and a surface facing the steel 3 that acts as an anode. The anode and cathode electrodes of the modifier 1 are connected, back to back, and face in opposite directions. Other electrode arrangements in the modifier 1 are also envisaged. In FIG. 1, lines in the electrolyte 4, with arrowheads, show the direction of the positive current flow through the electrolyte 4. The current is drawn from the sacrificial anode 2 through the modifier 1 to the steel 3 by the voltage between the anode and cathode of the modifier 1. The anode and cathode reactions, on the modifier 1, have the potential to increase the current that flows along the path that intersects the modifier 1, and increase the total current flowing from the sacrificial anode 2 to the steel 3. Furthermore, current that bypasses the modifier 1 is reduced or reversed. Thus, the current output of the sacrificial anode 2 may be directed through specific regions of the electrolyte 4 while the total current is increased.

In view of the above, the modifier 1 is like an electric current pump. On the inside, it drives current from its cathode to its anode. This may be used to change the current outside the modifier 1. It is to be appreciated that the modifier 1 may be used to increase the flow of external current, change the direction of the external current or even reverse the direction of the external current.

The electric field modifier 1 is preferably in the form of a sheet shaped as a tube or a hollow container. In one embodiment, the inner surface is the cathode and the outer surface is the anode. A sacrificial anode is typically located within the modifier 1 comprising the tube or the hollow container. To increase the current output of a sacrificial anode 2, the cathode of the modifier 1 faces the sacrificial anode 2 and the anode of the modifier 1 faces away from the sacrificial anode 2. The modifier 1 may comprise a single element or several discrete elements with gaps between them. Several modifiers 1 may be used either in series or in parallel with one another.

The anode of the modifier 1 is an electrode supporting an oxidation reaction, while the cathode of the modifier 1 is an electrode supporting a reduction reaction. Suitable oxidizable materials (also termed reducing agents or reductants) for the anode of the modifier 1 include, for example, zinc, aluminium, magnesium or alloys thereof. For use in concrete a zinc or zinc alloy anode is typically preferred. The oxidation reaction supported by a zinc anode is zinc dissolution.

The cathode of the modifier 1 includes an electron conducting surface (preferably a noble or passive electron conducting surface) on which reduction can take place together with a reducible material. Suitable reducible materials (also termed oxidizing agents or oxidants) for the cathode include oxygen and manganese dioxide. The electron conducting surface and the reducible material form an electrode that is more noble than the anode of the modifier 1 (i.e., the potential of the cathode is more positive than the potential of the anode). Suitable electron conducting surfaces, on which reduction can take place, are carbon, silver and nickel, for example. This surface preferably resists oxidation.

Other examples of possible anode and cathode materials, for the modifier 1, can be found in the field of battery technology. Cathode materials are usually oxygen from the air or solids that may be porous. Solid cathode materials include metal oxides such as manganese dioxide.

The modifier 1 differs from a cell or a battery in that the anode is connected to the cathode that faces away from the anode before use with a connection that allows electrons to flow between the anode and the cathode. The circuit is completed by the introduction of an electrolyte 4. In use the electrolyte connects the anode of the modifier 1 to the protected steel 3 and the electrolyte 4 connects the sacrificial anode 2 to the cathode of the modifier 1. An electrolyte connection, between the anode and the cathode of the modifier is not essential in order for the modifier 1 to function when the sacrificial anode is connected to the steel 3 by connection 5. The electrolyte connection, between the anode and the cathode of the modifier 1, is preferably initially omitted in order to preserve the shelf life of the modifier 1. By contrast, the anode and the cathode of a cell or a battery are connected by an electrolyte before use and the circuit is normally completed by electron conducting components when the cell or the battery is used.

As the modifier 1 operates, its oxidizable and reducible materials are consumed. Thus the modifier 1 has a limited service life that depends on the charge capacity of these materials. The life of the modifier will end with the complete consumption of either the oxidizable or the reducible material. Anode materials, like zinc for example, tend to have a relatively high charge density and occupy a small volume compared to cathode materials, like manganese dioxide for example. However, the volume of the cathode and therefore the modifier 1 may be minimized if oxygen, from the air, is used as the main reducible material. The cathode may then comprise a thin carbon or silver coating that facilitates the reduction of oxygen from the air. Such cathode is referred to as an air cathode and effectively has an unlimited life. The life of the modifier is then determined by its anode.

Both oxygen and water are required in order to support an air cathode, but oxygen is generally not available to support a relatively high cathodic reduction reaction rate in all environments. Oxygen from the air is readily available in concrete structures that are exposed to the air and periodically allowed to dry. In partially dry concrete, cathodic oxygen reduction rates, equivalent to a current density of more than 200 $mA/m^2$, are typical. This is more than an order of magnitude greater than the typical cathodic protective current densities in concrete and, under these conditions, an air cathode works well as it can promote and support high current densities. A modifier with an air cathode is, however, suitable for use in concrete dried in the air.

In other environments like salt water and soil, the cathodic protective current densities tend to be of the same order as than the limiting current equivalent to the rate of oxygen reduction and, in these environments, an air cathode in a modifier typically cannot be effective because oxygen access then limits the current output. A modifier with an air cathode will then block the current output of the sacrificial anode. A modifier 1 with an air cathode is, therefore, not generally suitable for use in soil or salt water.

FIG. 1 also shows that the direction of current in the electrolyte, that bypasses the modifier 1, may be reversed. The current flows through the electrolyte 4 from the anode of the modifier 1 to the cathode of the modifier 1. Reversing the current direction in the electrolyte 4, that bypasses the modifier 1, represents inefficient use of the charge in the modifier 1 in many circumstances. One method of minimizing the magnitude of the reversed current is to use a modifier 1 with a smaller potential difference between its anode and its cathode. A zinc-air modifier will have a potential difference, between its anode and cathode, that is similar to the potential difference between the sacrificial anode 2 and passive steel 3, for example, and will, therefore, tend to use its charge more efficiently than a modifier 1 with an anode cathode combination that has a higher potential difference.

In some cases, the useful life of the sacrificial anode 2 (i.e., the period of time that the sacrificial anode 2 has a capacity to deliver a galvanic protective current to the steel 3) may be substantially greater than the useful life of the modifier 1 (i.e., the period of time that the modifier has a capacity to increase the current that flows on a path that intersects the modifier). For example, the useful life of the sacrificial anode 2 may be two or three or ten times the useful life of the modifier 1. This is typical when a high current is required, only at the start of a galvanic treatment, to arrest a corrosion process in concrete as it results in the more efficient use of the charge of the sacrificial anode 2. In this case, a path for ionic conduction, between the sacrificial anode 2 and the protected steel 3, is required to continue to deliver the galvanic current once the charge in the modifier 1 expires. This may be achieved by leaving gaps or voids within the modifier 1 that are filled with a porous material containing the electrolyte 4, or by using a modifier 1 that is transformed into a porous solid containing the electrolyte 4 as it is consumed, or by a combination of these features.

A zinc-air modifier 1 may be transformed into a porous solid containing an electrolyte by the corrosion of the zinc and the disruption of the electron conducting surface of the cathode. The electron conducting surface may be disrupted, by the corrosion of the zinc, when there is a thin zinc surface treatment or coating attached to a zinc surface. Other modifiers with a cathode comprising a thin electron conducting surface in contact with a porous reducible material may also be transformed into a porous solid containing an electrolyte by consumption of the anode.

The charge in the sacrificial anode 2 may also be consumed more efficiently if the current output, of the sacrificial anode 2, responds to the aggressive nature of the environment. It is desirable for the protective current to respond positively to factors affecting steel corrosion risk. Thus, the sacrificial anode current output, in a dry or a cold environment, is generally lower than the current output in a hot or a wet environment. The use of a modifier 1 allows the current output of the sacrificial anode 2 to be boosted in a way without limiting the effects of the wet/dry or the hot/cold cycles on the current output of the sacrificial anode 2 that improve the efficient use of the charge in the sacrificial anode 2.

In some cases, it is desirable to direct the current off the sacrificial anode 2 to improve the current distribution. This is relevant when the sacrificial anode 2 is tied directly to the steel in uncontaminated repair material at an area of a corrosion damaged concrete repair. In this case, the current needs to flow to the steel and into the adjacent parent concrete. To boost this current, the modifier 1 may be positioned to the side of the sacrificial anode 2, facing away from the nearest or closest portion of steel 3. The cathode of the modifier 1 faces the sacrificial anode 2.

Figure 2:
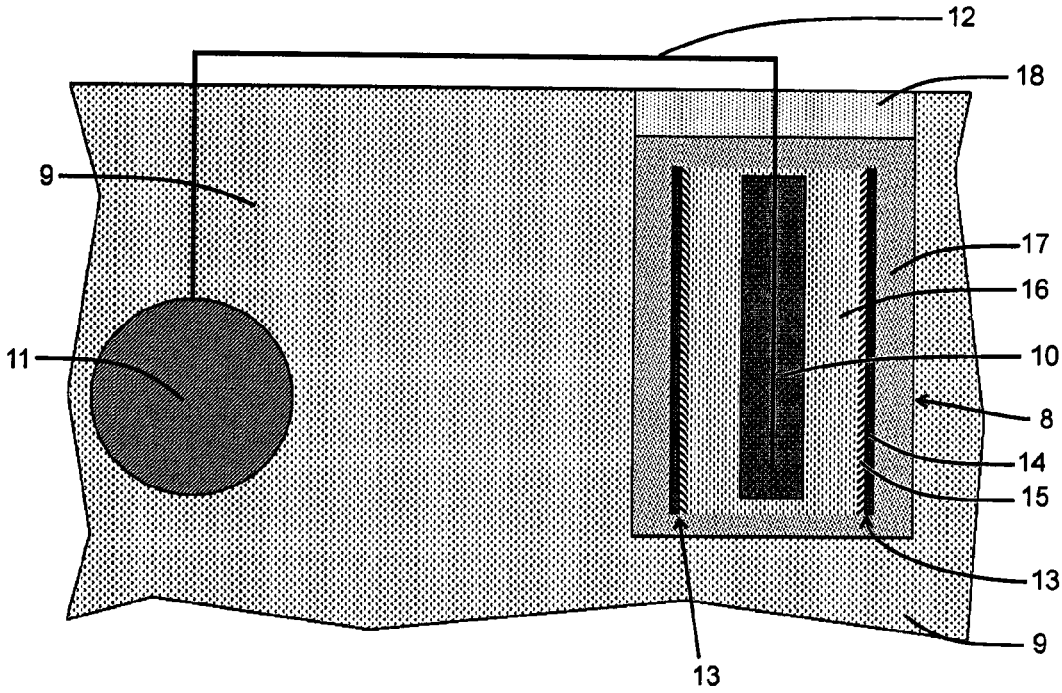
FIG. 2 diagrammatically shows an arrangement illustrating the use of a sacrificial anode/modifier assembly located within a cavity formed in the concrete for the purposes of installing the assembly.

FIG. 2 shows one arrangement illustrating the use of such a sacrificial anode/modifier assembly. This arrangement is suited for embedding the sacrificial anode/modifier assembly into a cavity 8 formed in the concrete which is sized to accept the sacrificial anode/modifier assembly. The cavity 8 may be a drilled or cored hole which is formed within the concrete 9 and is typically no more than about 50 mm in diameter. The sacrificial anode 10 is in the form of a bar located at the center of the hole or cavity 8 and typically is no more than about 200 mm in length and is cast around a conductor. The sacrificial anode 10 is connected to the steel 11 via a conductor 12 (e.g., typically an electric cable or a wire). It is desirable for the conductor 12 to substantially comprise of titanium as this also allows the sacrificial anode 10 to be used with an impressed current power supply driving a high current off the anode) which is a feature that may be used to manage future corrosion risk. The modifier 13, comprises an anode 14 and a cathode 15, is in the form of a tube or a hollow cylinder that substantially surrounds the sacrificial anode 10. The cathode may be an air cathode and oxygen from the air may diffuse into the tube through either of a top opening (see FIG. 2) or possibly a bottom opening. Such opening(s) also provides a path for ionic conduction between the sacrificial anode 10 and the steel 11 at the end of the useful life of the modifier 13.

A filler 16 provides an electrolyte for electrically coupling or connecting the sacrificial anode 10 to the cathode 15 of the modifier 13. The filler 16 will preferably be in the form of a porous solid or putty containing the electrolyte. A backfill 17 provides an electrolyte for connecting the anode 14 of the modifier 13 to the parent concrete 9. The backfill 17 and the filler 16 may conceivably be the same material or possibly different materials. However, the filler 16 is generally separated from the backfill 17 by a porous layer in which the pores are typically lined with a hydrophobic material. This allows oxygen to move to the air cathode but limits the formation of a path through the electrolyte, between the anode 14 and the cathode 15 of the modifier 13. A hydrophobic porous material may be produced by treating a porous material, like hydrated cement paste, with a silane based water repellent. The cavity 8 may be partially filled with the backfill and the sacrificial anode 10 and modifier 13 may be pressed into the backfill 17 such that the backfill 17 fills the spaces between the sacrificial anode 10, the modifier 13 and the parent concrete 9. The sacrificial anode 10 and the modifier 13 may be pre-assembled as a separate unit or assembly with the modifier 13 being attached to and spaced from the sacrificial anode 10. The sacrificial anode 10 must not be attached the modifier 13 with an electron conducting attachment or flow path. The assembly, within the cavity 8, may then be covered with a cementitious repair mortar or concrete 18, for example, as shown in FIG. 2.

An activating agent, adapted to maintain activity of the sacrificial anode 10, may be applied as a coating on the sacrificial anode 10, or it may be included within the filler 16 or within the body of the sacrificial anode 10. The anode 10 of the modifier 13 may also be coated with an activating agent, or aggressive ions in the concrete may be drawn to the anode 10 of the modifier by ionic current induced in the adjacent concrete in order to maintain the activity of the sacrificial anode 10.

Figure 3:
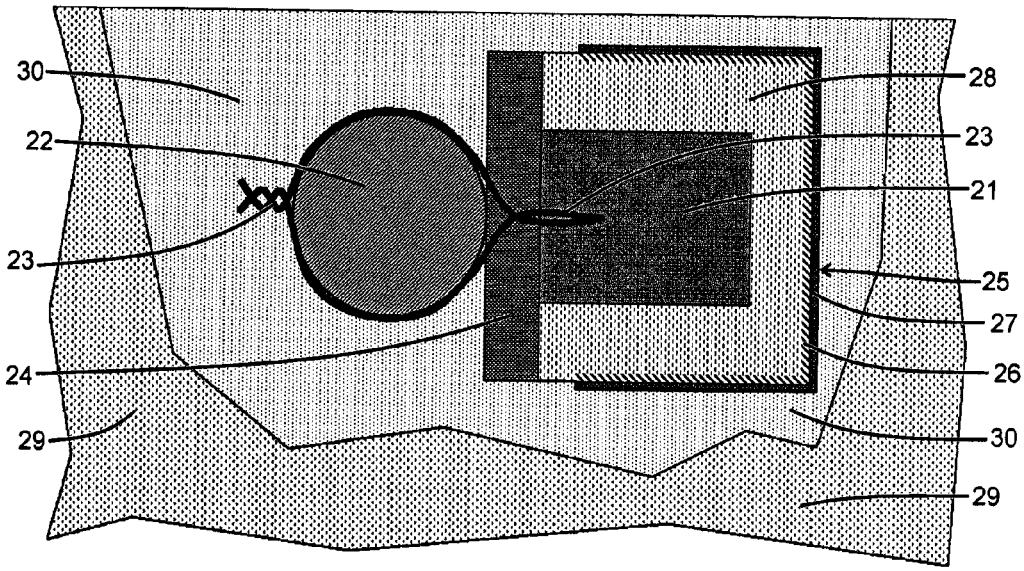
FIG. 3 diagrammatically shows an arrangement illustrating the use of a sacrificial anode/modifier assembly when installing the assembly in an area of a concrete patch repair.

FIG. 3 illustrates another arrangement of the use of the sacrificial anode/modifier assembly. This arrangement is suited for attaching the assembly to a steel bar exposed at an area of a concrete patch repair. The sacrificial anode 21 is attached to the steel bar 22 by an electron conducting tie 23. The sacrificial anode 21 may be spaced from the steel bar 22 by a spacer 24 in order to improve current distribution. The sacrificial anode 21 is substantially surrounded by a modifier 25 having a "U" shaped cross section. The modifier 25 comprises a cathode 26 facing the sacrificial anode 21 and an anode 27 facing away from the sacrificial anode 21. The modifier 25 is positioned so as to direct current away from the nearest region of the steel bar 22. The cathode 26 of the modifier 25 is connected to the sacrificial anode 21 by the electrolyte contained within a filler 28. The filler 28 is generally in the form of a porous solid or a porous putty. The pores of the filler 28 may be partially filled with air to promote the function of an air cathode. The electrolyte should also be present in the pores of the filler 28 to facilitate ionic conduction and electrochemical reactions, namely, oxidation at the sacrificial anode 21 and reduction at the cathode 26 of the modifier 25. The anode 27 of the modifier 25 may be connected to the concrete 29 by a cementitious concrete repair material 30, as shown in FIG. 3.

An activating agent, adapted to maintain activity of the sacrificial anode 21, may be applied as a coating on the sacrificial anode 21, or it may be included within the filler 28 or within the body of the sacrificial anode 21. The anode 27 of the modifier 25 may also be coated with or contain within its body an activating agent. The cathode 26 of the modifier 25 may be an air cathode and the ends of the "U" section modifier may be left open to facilitate the diffusion of oxygen, from the air, through the repair material 30 and filler 28 to the cathode 26 of the modifier 25. These openings also provide a path for ionic conduction between the sacrificial anode 21 and the steel 22 in the concrete 29 that bypasses the modifier 25 to facilitate the continued function of the sacrificial anode 21, once the charge in the modifier 25 is exhausted.

In the arrangement shown in FIG. 3, it is preferable to form an assembly comprising the sacrificial anode 21, the modifier 25 and the filler 28 as a preformed unit or assembly. The preformed assembly also includes the spacer 24, the connector 23 or a connection point, and an activating agent adapted to maintain activity of the sacrificial anode 21. Openings within the modifier 25, that are provided to facilitate the transfer or movement of oxygen from the air to the cathode 26, may be treated with a breathable hydrophobic treatment in order to improve the diffusion of oxygen from the air into the filler 28.

One aspect of the invention relates to a method of protecting steel, in hardened reinforced concrete elements exposed to air, which uses a combination comprising a sacrificial anode, an activating agent, an electric field modifier and an ionically conductive filler, the combination is embedded in a cavity, formed in a concrete element, and the sacrificial anode of the combination is connected to the steel and the sacrificial anode is a metal less noble than steel, the sacrificial anode is substantially surrounded by the modifier, the modifier comprises an element with a first side that is an anode supporting an oxidation reaction in electrical contact with a second side that is a cathode supporting a reduction reaction and the cathode of the modifier faces the sacrificial anode and is separated from the sacrificial anode by the filler, the filler is a porous material containing an electrolyte that connects the sacrificial anode to the cathode of the modifier, and the anode of the modifier faces away from the sacrificial anode.

It is desirable that the reduction reaction, on the cathode of the modifier, substantially comprises the reduction of oxygen from the air.

According to another aspect of the invention, the assembly comprises a sacrificial anode, an activating agent, an electric field modifier, and an ionically conductive filler, wherein the assembly is adapted to protect steel, in hardened reinforced concrete elements exposed to the air, the sacrificial anode is a metal less noble than steel, the sacrificial anode is substantially surrounded by the modifier, the modifier comprises an element with a first side that is an anode supporting an oxidation reaction in electronic contact with a second side that is a cathode supporting a reduction reaction, the reduction reaction on the cathode of the modifier substantially comprises the reduction of oxygen from the air, the cathode of the modifier faces the sacrificial anode and is separated from the sacrificial anode by the filler, the filler is a porous material containing an electrolyte that connects the sacrificial anode to the cathode of the modifier, and the anode of the modifier faces away from the sacrificial anode.

Another aspect of the invention relates to a method of protecting steel, in hardened reinforced concrete elements exposed to the air, using an assembly comprising a sacrificial anode, an activating agent and an electric field modifier wherein the assembly is embedded in a cavity formed in the concrete element, the sacrificial anode is connected to the steel, the sacrificial anode is a metal less noble than steel, the sacrificial anode is substantially surrounded by the modifier, the modifier comprises an element with a first side that is an anode supporting an oxidation reaction in electrical contact with a second side that is a cathode supporting a reduction reaction, the cathode of the modifier faces the sacrificial anode and is separated from the sacrificial anode, the anode of the modifier faces away from the sacrificial anode, a useful life of the sacrificial anode is substantially greater than a useful life of the modifier, and a path for ionic conduction between the sacrificial anode and the concrete is provided at least after the useful life of the modifier ends.

It is preferable that the reduction reaction on the cathode of the modifier substantially comprises the reduction of oxygen from the air.

A still further aspect of this invention relates to an assembly comprising a sacrificial anode, an activating agent and an electric field modifier, wherein the assembly is adapted to protect steel in hardened reinforced concrete elements exposed to air, the sacrificial anode is a metal less noble than steel, the sacrificial anode is substantially surrounded by the modifier, the modifier comprises an element with a first side that is an anode supporting an oxidation reaction in electronic contact with a second side that is a cathode supporting a reduction reaction, the cathode of the modifier faces the sacrificial anode and is separated from the sacrificial anode, the anode of the modifier faces away from the sacrificial anode, a useful life of the sacrificial anode is substantially greater than a useful life of the modifier, and the assembly is adapted to provide a path for ionic conduction between the sacrificial anode and the concrete at least after the useful life of the modifier ends.

Yet another aspect of the invention relates to an assembly comprising a sacrificial anode, an activating agent, an electric field modifier and an ionically conductive filler which protects steel in hardened reinforced concrete elements exposed to air at an area of concrete patch repair, wherein the assembly is adapted to be tied or otherwise connected to the steel on one side of the assembly, the sacrificial anode is a metal less noble than steel, the modifier comprises an element with a first side that is an anode supporting an oxidation reaction in electronic contact with a second side that is a cathode supporting a reduction reaction, the cathode of the modifier faces the sacrificial anode and is separated from the sacrificial anode by the filler, the filler is a porous material containing an electrolyte that electrically couples the sacrificial anode to the cathode of the modifier, the anode of the modifier faces away from the sacrificial anode, and the modifier is positioned relative to the sacrificial anode to enhance the current flowing in a direction away from the side of the assembly to be tied or otherwise connected to the steel and avoid current flowing in a direction towards the section of the steel to be protected.

EXAMPLE 1

An electric field modifier was constructed using a zinc casing of a standard zinc chloride D size cell (also referred to as a zinc-carbon battery with the International Electrotechnical Commission classification of R20). A sheet of zinc was cut from the casing and flattened and sanded to clean any deposit(s) from the zinc. It measured approximately 55×100 mm. One side of the zinc sheet was coated with two coats of an electrically conductive silver paint, of the type used to make electrical connections on circuit boards. The sheet was then baked at 240° C. for 15 minutes to remove the coating solvent. Carbon was then rubbed onto the silvered surface to produce a loose thin grey coating. Any coating on the reverse side of the zinc sheet was removed using a 220 grit sandpaper to leave a clean, bright zinc surface. The silver and carbon surface is designed to act as an air electrode (i.e., the cathode) and facilitate reduction of the oxidizing agent, e.g., oxygen, while the zinc surface is designed to provide the reducing agent (e.g., zinc) to be oxidized (i.e., the anode). When an electrolyte is added, the reduction of oxygen and the oxidation of zinc will provide an electric field to enhance current flow from the sacrificial anode to the zinc.

Figure 4:
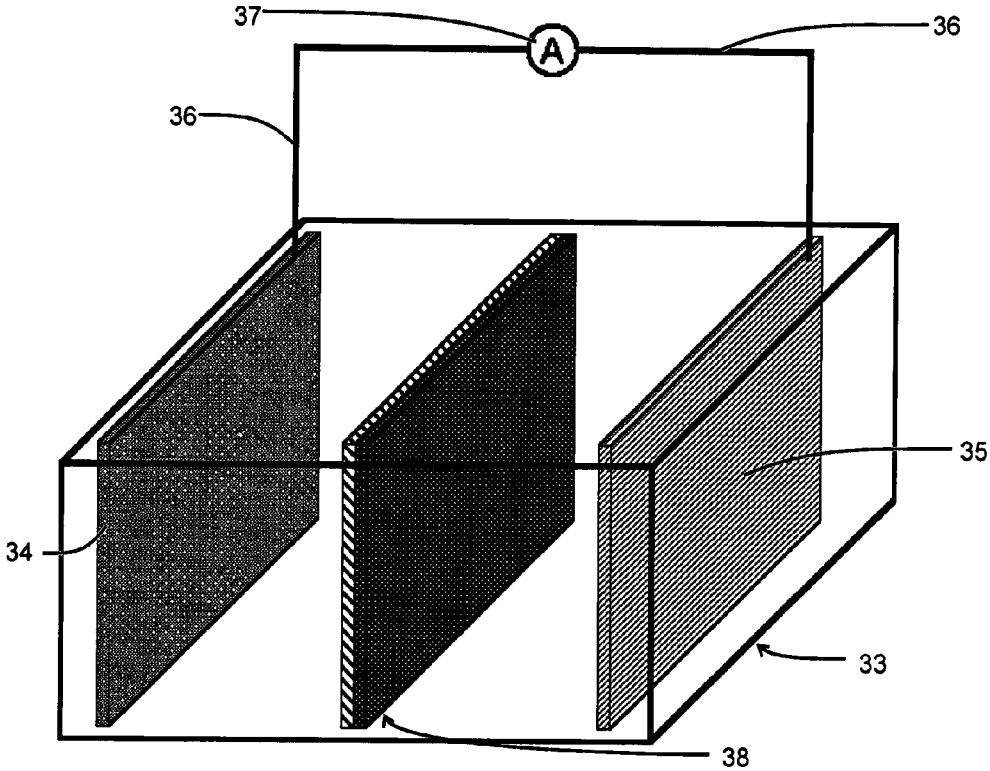
FIG. 4 shows the sandbox arrangement that was used to test the theory of Examples 1 and 2.

The test arrangement is shown in FIG. 4. A high resistivity sandbox was used in the place of a concrete or mortar to facilitate accelerated testing of this theory. For testing purposes, the sandbox 33 was formed using fine damp sand to simulate a high resistivity porous environment, similar to concrete. The sand was dampened with water, but it was not saturated, so as to provide some electrolyte and some air in a resistive porous environment. Approximately 1 kg of damp fine sand was mixed with a tablespoon of table salt to produce an environment that contained an activating agent for the zinc anodes. It was placed in a plastic container measuring 100×150×50 mm to form the sandbox 33. A clean zinc sheet, taken from a D-cell, was inserted into the sand adjacent one end of the sandbox 33 to act as an anode 34. A similarly sized sheet of steel 35 was inserted into the sand, adjacent the opposite end of the sandbox 33.

The zinc 34 was connected to the steel 35 via cables 36 and an ammeter 37. After 10 minutes, the initial galvanic current reduced to 0.55 mA. The rate of change at this point was sufficiently slow that, for a short term test, it could be regarded as being substantially stable.

The modifier 38 was then inserted into the sand, between the zinc sacrificial anode 34 and the steel 35, with its silver surface facing the zinc anode 34 and the zinc surface facing the steel 35. As the modifier 38 was inserted, the current began to rise. The current continued to rise, following insertion of the modifier 38, and peaked at 0.82 mA between 5 and 20 minutes. After 20 minutes, the current started to show signs of falling. The galvanic couple was left connected overnight. After 10 hours, it again measured at 0.68 mA.

The sandbox 33, with the modifier 38, was then placed in a warmer environment. After 39 hours, the sandbox 33 had warmed up to about 20 to 25° C. The current was again measured and this time the current measured 1.26 mA. The modifier 38 was removed and, after 30 minutes, the current then stabilised at 0.48 mA. The modifier 38 was again inserted into the sand, but this time it was rotated so the silvered surface faced the steel 35. The current fell to −0.08 mA. The electric field of the modifier 38 completely overcame the electric field of the zinc steel couple and reversed the flow direction of the current.

Figure 5:
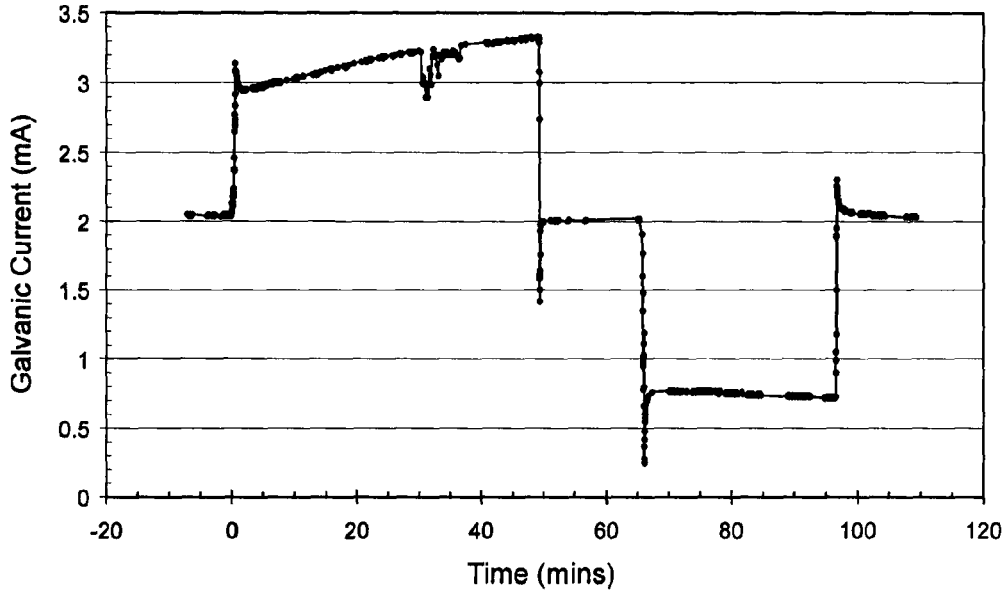
FIG. 5 shows the changes in galvanic current output when an electric field modifier was inserted into and removed from the sand in Example 1.

After water had been added to the sand, to replace water lost through evaporation, the above experiment was then repeated. The current between the zinc sacrificial anode 34 and the steel 35 was recorded using a datalogger. The current-time behaviour is shown in FIG. 5.

The starting galvanic current was measured without the modifier 38 being present. The galvanic current stabilized at just over 2 mA. The modifier 38 was then inserted, at time zero in FIG. 5, between the sacrificial anode 34 and the steel 35 with the cathode of the modifier 38 facing the sacrificial anode 34. Over the next 45 minutes, the galvanic current increased to 3.3 mA. After 45 minutes, the modifier 38 was removed and the galvanic current again fell back to 2 mA for 20 minutes. After 65 minutes, the modifier 38 was again inserted, between the sacrificial anode 34 and the steel 35, but this time the anode of the modifier 38 faced the sacrificial anode 34. The galvanic current fell to 0.7 mA for 30 minutes. After 95 minutes the modifier 38 was again removed and the galvanic current rose to 2 mA.

The above test has shown that a modifier 38 may be used to substantially increase or decrease the current output of the sacrificial anode.

EXAMPLE 2

Two electric field modifiers of approximately 55×50 mm in size were constructed using the same zinc sheet, as described in Example 1. One side of each zinc sheet was first coated with two coats of silver paint and then baked, as described in Example 1. Thus one side of each sheet was zinc and the other side was a conductive silver coating. The silver coated surface was then coated with a carbon rich paint. Two make the carbon paint, the carbon bar from the center of a zinc-carbon battery was sanded down to produce a fine carbon powder.

The power was mixed with a drop of clear outdoor varnish and approximately 10 times as much varnish solvent thinner. A carbon to binder ratio, in the dry paint film of somewhat greater than 10:1, was targeted. The painted zinc sheet was then baked further to remove the solvent. The conductivity of the painted surface was checked using a resistance meter with two probes which were lightly pressed onto the carbon coated surface. The resistivity was less than 1 ohm. One of these sheets will be referred to as the zinc-air modifier.

A manganese dioxide-carbon mixture was then applied to the carbon coated surface of the second of the zinc-carbon sheets. The manganese dioxide-carbon mixture was sourced from the cathode side of a standard zinc chloride D size cell. It was applied as a layer to the carbon coated surface of one zinc-carbon sheet and then covered with wall paper paste and then covered with a thin absorbent paper tissue and then pressed firmly together under a weight of approximately 60 kg. The manganese dioxide-carbon mixture and absorbent tissue was then trimmed to the edge of the zinc sheet to provide a zinc sheet with a 2 mm thick manganese dioxide-carbon layer on one side and uncoated zinc on the other side. This modifier is referred to as a zinc-manganese dioxide ($MnO_2$) modifier.

A batch of a damp fine sand-salt mixture, containing both an electrolyte and air, was made as described in Example 1. The mixture was used to fill three small sandboxes 33, each measuring 90×65×35 mm. A bare zinc sheet measuring approximately 55×50 mm was partially inserted adjacent one end of each sandbox 33 and a similarly sized steel sheet was partially inserted into the other end of each sandbox 33. In each sandbox 33, the zinc was connected to the steel through a 100 ohm resistor to form a galvanic cell. A galvanic current flowed through the resistor and produced a voltage that was measured in order to monitor the galvanic current. The general layout was similar to that shown in FIG. 4, with the ammeter being replaced by a 100 ohm resistor.

The galvanic currents in the sandboxes 33 were first measured, without any modifiers being used. The sandbox 33 that produced the highest galvanic current was chosen to be the control. The zinc-air modifier was inserted between the zinc sacrificial anode and the steel of the second sandbox 22. The carbon surface of the modifier faced the zinc sacrificial anode. The zinc-manganese dioxide modifier was inserted between the zinc sacrificial anode and the steel of the third sandbox. The manganese dioxide surface of the modifier faced the zinc sacrificial anode. The galvanic current was logged during this process.

Figure 6:
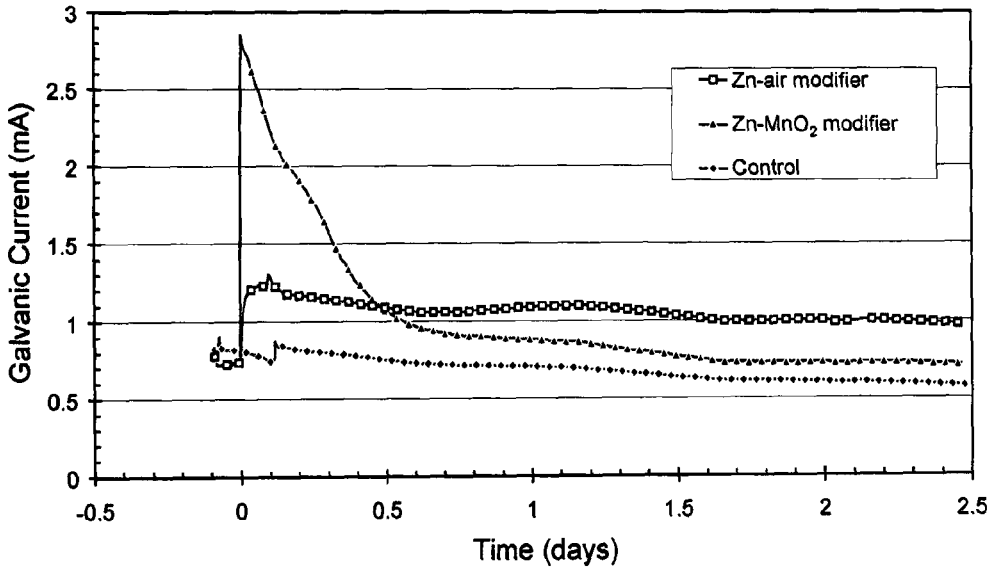
FIG. 6 shows the early galvanic current output of a control test and test samples involving two different modifiers of Example 2.
Figure 7:
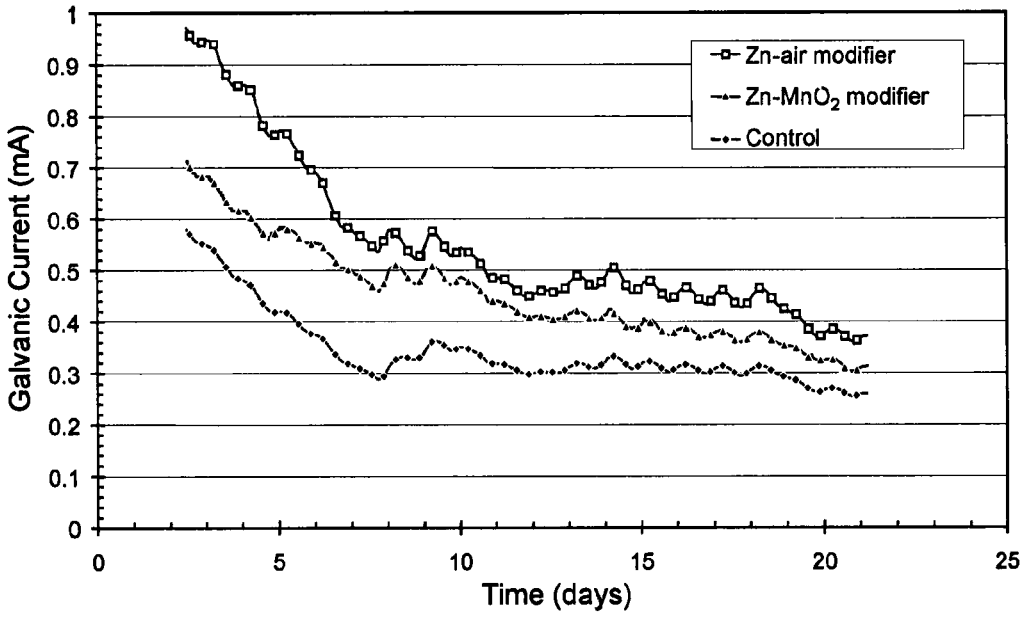
FIG. 7 shows the medium term galvanic current output of a control test and tests involving two different modifiers of Example 2.

The galvanic currents from the three sandboxes 33 are shown in FIGS. 6 and 7. In these figures, the electric field modifiers were inserted into the sand, between the zinc anode and the steel, at time zero. Immediately after the modifiers were inserted, the galvanic cell with the zinc-manganese dioxide modifier produced the highest galvanic current (see FIG. 6). However, over the next 10 hours, this initially high current eventually decayed and then the galvanic cell with the zinc-air modifier eventually produced the highest galvanic current. The currents from all three cells decayed at a slow rate, probably as the result of the sand between the zinc and the steel drying out. After 7 days, the sandboxes were inserted into a large plastic bag to slow the rate of further drying of the sand and the galvanic currents eventually stabilized, to primarily show daily fluctuations that would be associated with daily variations in temperature (see FIG. 7). Over time, the galvanic current, produced by the cell with the zinc-manganese dioxide modifier, recovered to a value closer to that of the zinc-air modifier.

These results again indicate that an electric field modifier is capable of substantially boosting the short term current output off the sacrificial anode. In addition, a modifier with a more powerful manganese dioxide cathode, at the start, may become a modifier with an air cathode after the manganese dioxide is spent as a cathode.

EXAMPLE 3

Figure 8:
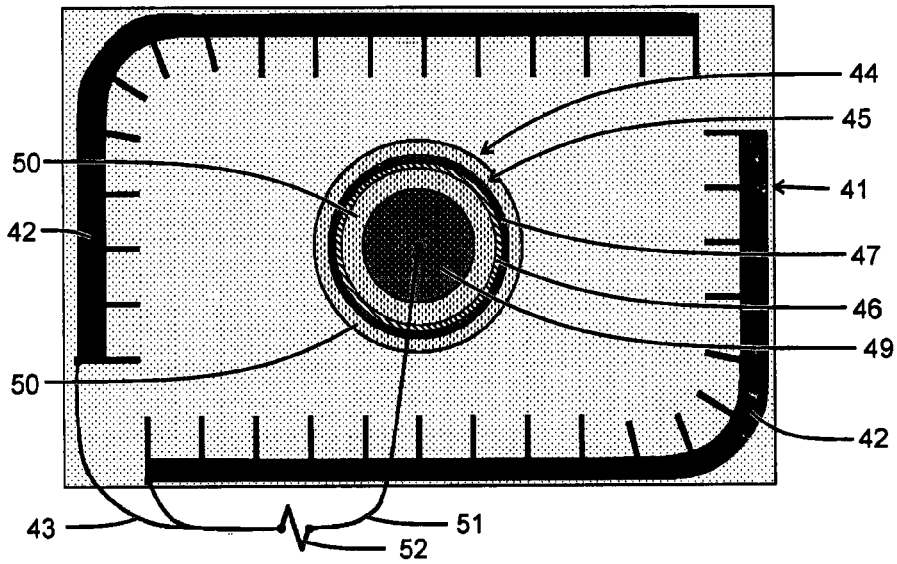
FIG. 8 shows the experimental arrangement, used in Example 3, to test the effect of a modifier on the protective current delivered to the steel in a cement mortar.
Figure 9:
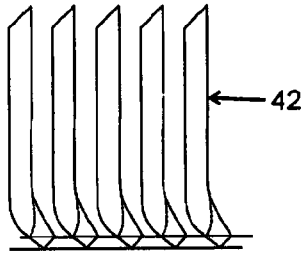
FIG. 9 shows a section of the steel cathode that was used in Example 3.

FIG. 8 shows the test arrangement for Example 3. According to this embodiment, two cement mortar blocks 41, each 270 mm long by 175 mm wide by 110 mm high, were cast using damp sand, Portland Cement® and water in the weight ratio 4:1:0.8. The mortar was of a relatively poor quality and some bleed water formed on top of the casting. During the casting process, a steel cathode 42, with a surface area of 0.12 $m^2$, was positioned within the outer edge of each mortar block. The steel cathode 42 was formed from two 300 mm by 100 mm steel shims that were cut and folded to form a set of 20 mm wide by 90 mm long steel strips connected by a 10 mm by 300 mm strip, to allow both sides of the steel to receive current during the testing process. A segment of the cut and folded steel cathode 42 is shown in FIG. 9. An electric cable 43 was connected to the steel cathode 42 and extended beyond the cement mortar 41 to enable electrical connections to be made to the steel cathode 42. A hole 44, 40 mm in diameter by 70 mm deep, was formed in the center of the cement mortar block 41 to house a sacrificial anode assembly. The cement mortar blocks were covered and left for 7 days to cure.

An electric field modifier 45 was made from the zinc cylinder from a standard zinc chloride D size cell, described in Example 1, after removing the base, top and inside of the cell. The zinc cylinder measured 32 mm in diameter by 55 mm long. It was lightly sanded and washed with soap to remove any deposit(s). The inside of the zinc cylinder was then coated with two coats of silver conductive paint and one coat of carbon conductive paint and baked, as described in Example 2, to form the cathode 46 of the modifier 45. The outer surface of the cylinder formed the anode 47 of the modifier 45. A salt paste, consisting of a starch based wall paper paste and table salt, e.g., primarily sodium chloride, in equal volumes was mixed up and applied to the outer zinc surface of the modifier. The modifier was then baked again in an oven at 240° C. for 15 minutes to dry the salt paste and form a crusty layer of salt on the outer zinc surface. The purpose of the salt-starch coating was to provide an activating agent for the zinc anode. This modifier 45 is referred to as a zinc-air modifier as the anode reaction, is the dissolution of zinc, and the cathodic reaction, is the reduction of oxygen from the air.

Two zinc sacrificial anodes were formed by casting a 15 mm diameter, 35 mm long bar of zinc around a titanium wire. The surface of the zinc bar was coated with the salt paste, described above, and baked to form a crusty layer of salt on the zinc surface.

After the cement mortar specimens had cured for 7 days, the 40 mm diameter hole in the center of each specimen was partially filled with lime putty 50 and the zinc sacrificial anode 49 was inserted into the lime putty 50 such that the sacrificial anode 49 and the putty 50 filled approximately 85% of the space within the hole. The sacrificial anode 49 was connected to the steel cathode 42 by an electric cable 51 and a 100 ohm resistor 52 and the galvanic current was measured and recorded, as described in Example 2. The two specimens were left to stabilize for 1.5 hrs and the specimen that produced the highest galvanic current was selected as the control specimen, while the second specimen was used to test the zinc-air modifier.

After 1.5 hours, water was added to the lime putty 50, of both specimens, to soften the lime putty 50. The zinc-air modifier 45 was then pressed into the lime putty 50 around the sacrificial anode 49 in one specimen to substantially surround the sacrificial anode 49. The galvanic currents were recorded and are provided in FIGS. 10, 11 and 12. In these figures, time zero is the time when the modifier 45 was inserted into one of the specimens—the control specimen did not have any modifier inserted therein.

Figure 10:
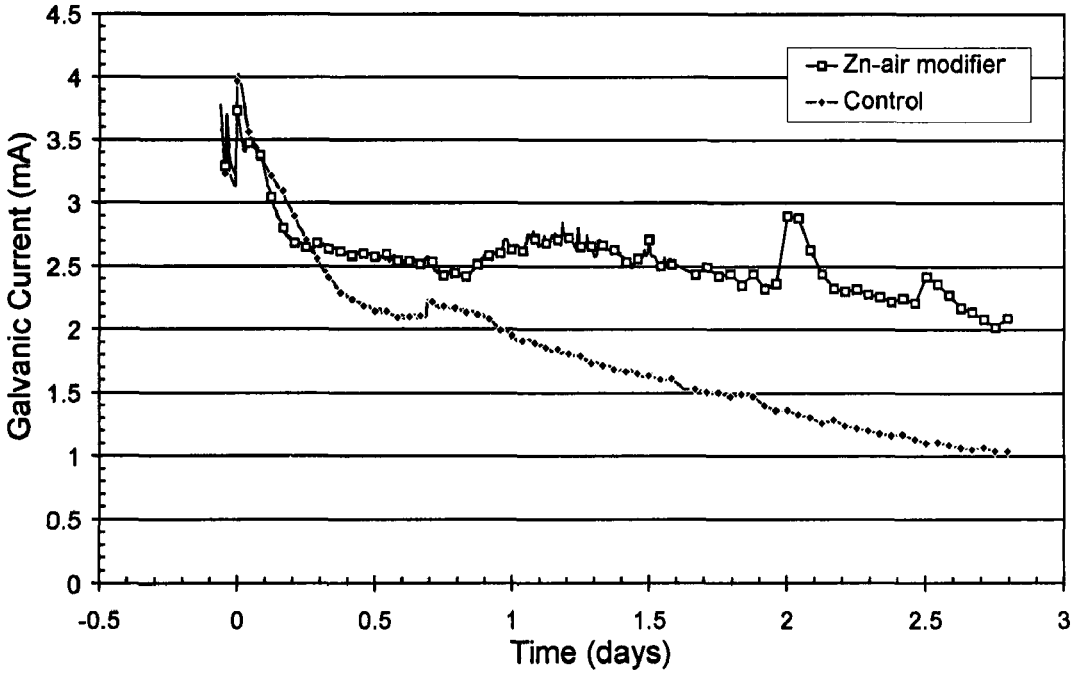
FIG. 10 shows the early galvanic current output of a control test and a test sample involving a modifier of Example 3.

Initially, no positive effect of the modifier 45 was seen FIG. 10. Indeed the effect appeared to be negative. The wet control specimen appeared to deliver substantially more current than the wet specimen with the modifier 45. However, as the lime putty 50 began to dry and harden, a significant positive effect of the modifier 45 became evident.

To explain this observation, it is noted that a galvanic current of 3 mA is a relatively high current for such a small sacrificial anode assembly in a cement mortar. It equates to a cathode current density for the modifier of 550 $mA/m^2$. It is postulated that it is difficult for the cathode 46 of the modifier 45 to support such a high current density in a very moist putty 50 as oxygen, from the air, must come into contact with the carbon on the cathode 46 of the modifier 45 to sustain the cathodic reduction reaction. As the putty 50 dries, oxygen has easier access to the cathode 46 of the modifier 45 while the anode reactions (the dissolution of zinc) become more restricted. Thus, the modifier 45 tends to sustain the current as the putty 50 dries and hardens. This observation indicates that, in this example, both electrolyte and air are needed for the modifier to work.

After 2.6 days, the sacrificial anode assembly, in each cement mortar specimen, was covered with cement mortar which filled the remainder of the hole or cavity. The two specimens were placed outside and exposed to the weather of the UK Midlands. The weather was initially sunny and dry with direct sunlight falling on the specimens in the late afternoon and the specimens were drying fairly rapidly. This weather was sustained until day 11. The daily maximum air temperature rose from 17° C., on day 3, to 26° C., on days 8 and 9. On day 12, the first of a series of cold fronts passed over the region and the daily maximum temperature dropped to a low of 13° C. There were also more clouds and less sunshine. On day 15, it began to rain with some significant rain showers wetting the specimens. Intermittent showers continued through to day 19. On day 17, the position of the control and zinc-air modifier mortar blocks was switched to minimize the effect of any changes in microclimate. By day 20, the daily maximum air temperature rose to 17° C.

Figure 11:
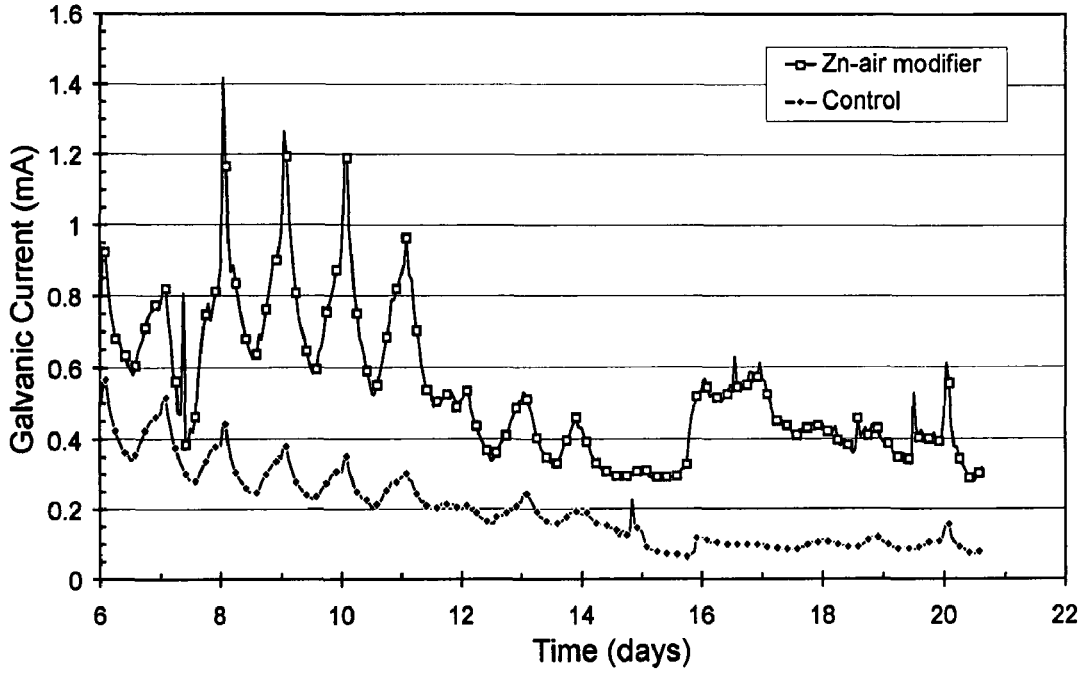
FIG. 11 shows the galvanic current output, from day 6 to day 21, of a control test and a test sample involving a modifier of Example 3.

The galvanic currents from the two specimens, between days 6 and 21, are provided in FIG. 11. The data suggests the modifier 45 has a substantial positive effect on the galvanic current output of the anode assembly. The modifier 45 resulted in an average galvanic current, over any 24 hour period, for day 6 onward that was between 1.6 and 5.6 times higher than the control specimen. The effect of the daily variations in air temperature and rain, on day 15, are also evident in the data and indicates that a beneficial responsive behaviour of the protective current output to changes in the aggressive nature of the cement mortar was retained and amplified by the presence of the modifier 45. The most pronounced daily variations occurred between days 7 and 12, when the specimens were directly heated by the sun's radiation. These pronounced variations disappeared when the weather clouded over. The effect of wetting the specimen, with rain water, is a slower process that occurred after day 15.

Figure 12:
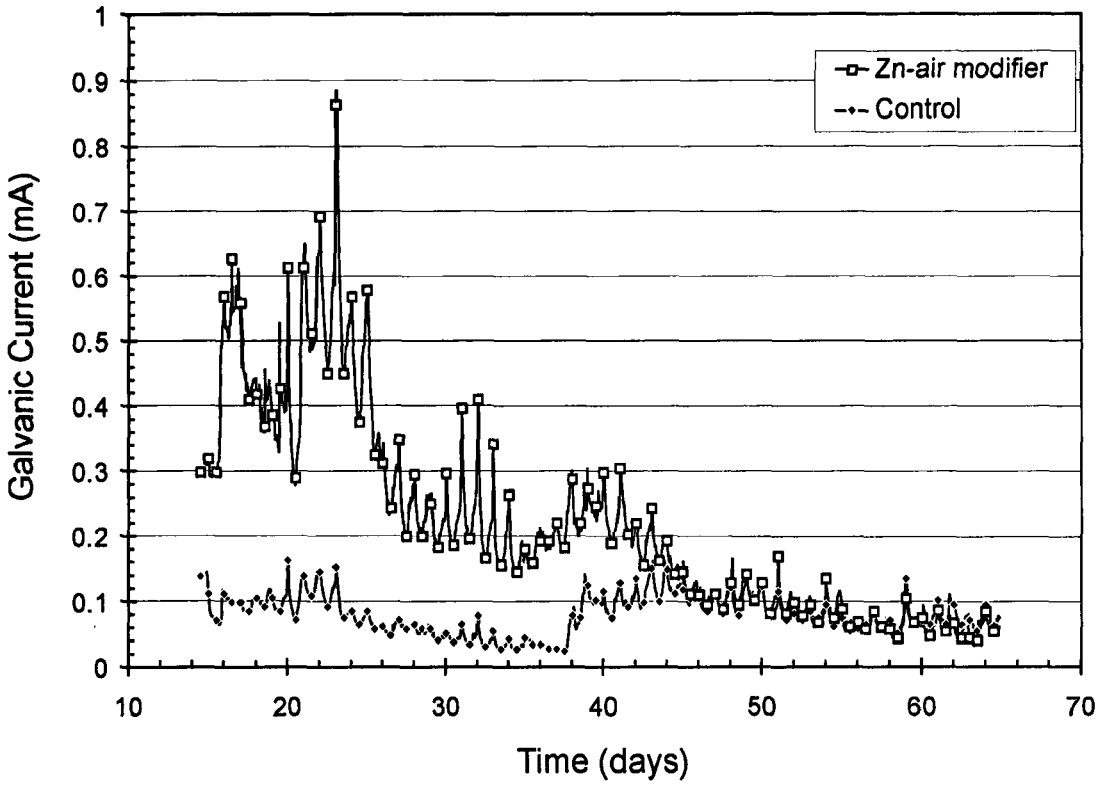
FIG. 12 shows the galvanic current output, from day 15 to day 60, of a control test and a test sample involving a modifier of Example 3.

The galvanic currents from the two specimens, between days 15 and 65, are provided in FIG. 12. The data suggests that the effect of the modifier 45 lasted until day 45. After the modifier 45 expired, the sacrificial anode 49 continued to deliver current at a similar magnitude to the control specimen. Thus, it is possible to produce an anode assembly with a modifier where the modifier delivers an initial boost in the sacrificial anode current output without any substantial effect on the longer term galvanic current output of the sacrificial anode.

We claim:

1. A sacrificial anode assembly, for protecting steel in a hardened reinforced concrete element exposed to air, comprising:

a sacrificial anode being a metal less noble than steel; and an electric field modifier substantially surrounding the sacrificial anode and comprising, on a first side facing away from the sacrificial anode, a modifier anode which supports an oxidation reaction and, on a second side facing toward the sacrificial anode, a modifier cathode which supports a reduction reaction, the modifier anode being in electrical contact with the modifier cathode;

the modifier cathode being separated from the sacrificial anode;

a useful life of the sacrificial anode being substantially greater than a useful life of the electric field modifier; and the assembly providing a path for ionic conduction between the sacrificial anode and the concrete element at least after the useful life of the electric field modifier ends.

2. The sacrificial anode assembly according to claim 1, wherein the modifier anode comprises a metal selected from the group consisting of zinc, aluminum, magnesium, a zinc alloy, an aluminum alloy and a magnesium alloy; and the modifier cathode comprises a material selected from the group consisting of manganese dioxide, carbon, silver, nickel, and a manganese dioxide-carbon mixture.

3. The sacrificial anode assembly according to claim 1, wherein an activating agent at least partially contacts the sacrificial anode.

4. The sacrificial anode assembly according to claim 1, wherein the electric field modifier has voids which are at least partially filled with at least one of an electrolyte and a breathable hydrophobic material.

5. The sacrificial anode assembly according to claim 1, wherein the reduction reaction, on the modifier cathode, substantially comprises the reduction of oxygen from the air.

6. The sacrificial anode assembly according to claim 1, wherein the sacrificial anode assembly further comprises an activating agent for activating the sacrificial anode.

7. A sacrificial anode assembly comprising:

an attachment side for direct attachment to a section of steel, a sacrificial anode being a metal less noble than steel;

an electric field modifier; and a connector for electronic connection of the sacrificial anode to steel in a reinforced concrete element;

wherein the sacrificial anode is at least in part surrounded by the electric field modifier, and the electric field modifier comprises an element with a first side that is a modifier anode which supports an oxidation reaction in electrical contact with a second side that is a modifier cathode which supports a reduction reaction;

the modifier cathode faces the sacrificial anode and is separated from the sacrificial anode;

the modifier anode faces away from the sacrificial anode; and the electric field modifier is positioned, relative to the sacrificial anode, to enhance a flow of current in a direction away from the attachment side.

8. The sacrificial anode assembly according to claim 7, wherein the modifier anode comprises a metal selected from the group consisting of zinc, aluminum, magnesium, a zinc alloy, an aluminum alloy and a magnesium alloy, and the modifier cathode comprises a material selected from the group consisting of manganese dioxide, carbon, silver, nickel, and a manganese dioxide-carbon mixture.

9. The sacrificial anode assembly according to claim 7, wherein an activating agent at least partially contacts the sacrificial anode.

10. The sacrificial anode assembly according to claim 7, wherein the electric field modifier has voids which are at least partially filled with at least one of an electrolyte and a breathable hydrophobic material.

11. The sacrificial anode assembly according to claim 7, wherein the reduction reaction, on the modifier cathode, substantially comprises the reduction of oxygen from the air.

12. The sacrificial anode assembly according to claim 7, wherein the sacrificial anode assembly further comprises an ionically conductive filler connecting the sacrificial anode to the electric field modifier.

13. A sacrificial anode assembly comprising:

a sacrificial anode being a metal less noble than steel;

a connector for electronically connecting the sacrificial anode to steel in a reinforced concrete element; and an electric field modifier substantially surrounding the sacrificial anode;

wherein the assembly protects steel in a hardened reinforced concrete element exposed to air;

the electric field modifier comprises an element with a first side that is a modifier anode which supports an oxidation reaction in electrical contact with a second side that is a modifier cathode which supports a reduction reaction;

the reduction reaction on the modifier cathode substantially comprises the reduction of oxygen from the air;

the modifier cathode faces the sacrificial anode and is separated from the sacrificial anode; and the modifier anode faces away from the sacrificial anode.

14. The sacrificial anode assembly according to claim 13, wherein an activating agent at least partially contacts the sacrificial anode.

15. The sacrificial anode assembly according to claim 13, wherein the electric field modifier has voids which are at least partially filled with at least one of an electrolyte and a breathable hydrophobic material.

16. The sacrificial anode assembly according to claim 13, wherein the reduction reaction, on the cathode of the modifier, substantially comprises the reduction of oxygen from the air.

17. The sacrificial anode assembly according to claim 13, wherein the sacrificial anode assembly further comprises a breathable hydrophobic material for promoting movement of oxygen in air to the modifier cathode.

18. The sacrificial anode assembly according to claim 13, wherein the sacrificial anode assembly further comprises an ionically conductive filler connecting the sacrificial anode to the electric field modifier.

19. A method of protecting steel in a hardened reinforced concrete element exposed to air with a sacrificial anode assembly, the sacrificial anode assembly comprising a sacrificial anode, an activating agent and an electric field modifier; the sacrificial anode is a metal less noble than steel; the sacrificial anode is substantially surrounded by the electric field modifier; the electric field modifier comprises an element with a first side which comprises a modifier anode which supports an oxidation reaction in electrical contact with a second side that is a modifier cathode which supports a reduction reaction; the modifier cathode faces the sacrificial anode and is separated from the sacrificial anode; the modifier anode faces away from the sacrificial anode; and a useful life of the sacrificial anode is substantially greater than a useful life of the electric field modifier; and the method comprising the steps of:

forming at least one cavity in a concrete element;

embedding the sacrificial anode assembly within the at least one cavity;

connecting the sacrificial anode to the steel to be protected;

activating the sacrificial anode assembly to protect the steel in the concrete element; and once the useful life of the electric field modifier ends, the assembly providing a path for ionic conduction between the sacrificial anode and the concrete element.

20. The method of protecting steel according to claim 19, further comprising the step of reducing oxygen from the air during the reduction reaction on the cathode of the electric field modifier.

21. A method of protecting steel in a hardened reinforced concrete element exposed to air with a sacrificial anode assembly, the sacrificial anode assembly comprising a sacrificial anode, an activating agent, an electric field modifier, the sacrificial anode is a metal less noble than steel; the sacrificial anode is substantially surrounded by the electric field modifier; the electric field modifier comprises an element with a first side that is a modifier anode which supports an oxidation reaction in electrical contact with a second side that is a modifier cathode which supports a reduction reaction; the reduction reaction on the modifier cathode substantially comprises the reduction of oxygen from the air; the modifier cathode faces the sacrificial anode and is separated from the sacrificial anode; and the modifier anode faces away from the sacrificial anode; and the method comprising the steps of:

connecting the sacrificial anode to the modifier cathode with an electrolyte;

forming at least one cavity in a concrete element;

embedding the sacrificial anode assembly within the at least one cavity;

connecting the sacrificial anode to the steel to be protected; and activating the sacrificial anode assembly to protect the steel in the concrete element.

22. The method of using the sacrificial anode assembly to protect the steel according to claim 21, further comprising the step of forming the electrolyte connection from the sacrificial anode to the modifier cathode when the assembly is embedded within the cavity.

* * * * *